United States Patent [19]

Newcomb

[11] Patent Number: 4,630,060

[45] Date of Patent: Dec. 16, 1986

[54] VERTICAL ANTENNA WITH DECOUPLING SECTIONS FOR MULTIBAND OPERATION

[75] Inventor: Donald R. Newcomb, Lockhart, Tex.

[73] Assignee: Butternut Electronics Co., Lockhart, Tex.

[21] Appl. No.: 541,062

[22] Filed: Oct. 12, 1983

[51] Int. Cl.[4] ..... H01Q 9/14

[52] U.S. Cl. ..... 343/722; 343/750

[58] Field of Search ..... 343/722, 724, 749, 750, 343/752, 802, 831

[56] References Cited

U.S. PATENT DOCUMENTS 4,442,436 4/1984 Newcomb ..... 343/722

*Primary Examiner*—Eli Lieberman
*Assistant Examiner*—Michael C. Wimer
*Attorney, Agent, or Firm*—Hugh D. Jaeger

[57] ABSTRACT

An eight-band vertical antenna which is omnidirectional and includes completely automatic band switching for the amateur radio frequencies of eighty/seventy-five meters, forty meters, thirty meters, twenty meters, seventeen meters, fifteen meters, twelve and ten meters. The vertical antenna has a low angle of radiation and a low standing wave ratio on all frequencies which provides for direct coaxial cable transmission line feed. The eighty-meter and forty-meter inductor-capacitors are in parallel while the thirty-meter inductor-capacitor is in series with a portion of the forty-meter circuit providing inductive reactance for operation on eighty/seventy-five meters, forty meters, and thirty meters with a series inductor-capacitor connected between an upper vertical radiating element and the forty-meter inductor while permitting simultaneous resonance on each of the three higher frequencies of twenty, fifteen and ten meters. The entire radiator length of the vertical antenna is active on all frequencies except for fifteen meters where the upper portion of the antenna is decoupled above an end of a fifteen-meter quarter-wave decoupling stub. The seventeen- and twelve-meter circuits provide for decoupling so that the entire radiator length of the vertical antenna is active.

6 Claims, 2 Drawing Figures

VERTICAL ANTENNA WITH DECOUPLING SECTIONS FOR MULTIBAND OPERATION

BACKGROUND OF THE INVENTION

1. Field of the Invention

The present invention relates generally to an antenna, and more particularly pertains to a high-frequency vertical antenna for eight bands or nine bands with a 160-meter (1800 KHz) add-on adapter.

2. Description of the Prior Art

Those concerned with antennas have long recognized the need for a high-frequency vertical antenna including automatic band switching for all band amateur usage. The present invention fulfills this need.

The traditional prior art vertical antennas have relied on anti-resonant inductor-capacitor circuit traps placed at or near the quarter-wave current antinode points to decouple varying lengths of the available radiating structure on those bands where the total height of the vertical antenna was greater than an electrical quarter wavelength. The approach provided that the overall height of the radiating structure was typically less than a quarter wavelength at the lowest frequency of operation and the exact height was largely determined by the inductance-capacitance ratio of the traps. The usual method of providing eighty-meter resonance in vertical antennas was to utilize a high inductance coil at the top of the structure which simultaneously served as a forty-meter decoupling trap and as a loading for eighty-meter resonance. In most designs, additional loading in the form of capacity hats was used to limit the overall height of the structure to something less than one-eighth wavelength on the lowest frequency. The physical height of the active radiating sections was usually less than a quarter wavelength because of the inductive reactance of the several decoupling traps at frequencies below the frequencies to which the decoupling traps were tuned.

The prior art vertical antennas have had a number of limitations. First, the active antenna height on all but the highest frequency band was necessarily less than one-quarter wavelength resulting in a radiation resistance which progressively decreased from a high impedance on the highest frequency of operation to a few ohms on the lowest frequency of operation. Second, the use of numerous traps and other loading devices increased the system Q and unnecessarily restricted the band width, especially on the mid-range HF (high frequency) frequencies where the active radiator height would be less than that required for unloaded resonance operation. Third, from a mechanical viewpoint, the use of numerous traps and loading devices in the upper sections of the vertical antenna made for a relatively unstable and heavy structure which required heavy and expensive construction for a freestanding wind survival rating. Fourth, a further difficulty had to do with the ease of adjustments for resonance at the desired frequencies in the low HF frequencies. Inasmuch as adjustment in the past for these frequencies had to be made in the upper sections of the antenna, the entire vertical antenna had to be removed from its mounting and brought to ground level for the slightest readjustment. This was a particularly inconvenient feature of operation as the effective operating band width of the vertical antenna was generally less than three percent of the authorized band spectrum.

The present invention provides a vertical antenna that overcomes all the disadvantages of the prior art vertical antennas and provides for eight bands of operation, particularly in the amateur frequencies or nine bands of operation with an add-on adapter for 160-meter operation.

SUMMARY OF THE INVENTION

The general purpose of this invention is to provide a high-frequency vertical antenna which is resonant on eight amateur radio HF bands or eight HF frequencies.

According to one embodiment of the present invention, there is provided a high-frequency vertical antenna for use on the amateur radio high-frequency spectrum segments having an insulated eighty-meter supported section and including an adjustable parallel inductor-capacitor connected across the section, an insulated forty-meter supported section connected to the eighty-meter section and including an adjustable parallel capacitor-inductor connected across the section, a thirty-meter series inductor-capacitor connected between the forty-meter inductor and above the forty-meter inductor to a point on an upper radiating section, a seventeen-meter circuit connected across a mid-portion of the vertical element, a twelve-meter circuit connected across a mid-portion of the vertical element above the seventeen-meter circuit, and an upper vertical radiating section including a fifteen-meter quarter-wave stub section connected to the vertical radiating section whereby the overall antenna height is resonated on eighty and forty meters, the vertical antenna resonates as a quarter wavelength on thirty meters and twenty meters, the vertical antenna resonates as a quarter wavelength on fifteen meters on account of decoupling of the upper vertical radiating section of the antenna by the fifteen-meter stub section, and the vertical antenna resonates as three-quarters wavelength on ten meters.

One significant aspect and feature of the present invention is a vertical antenna which is omnidirectional including inherent automatic band switching for operating on eight HF amateur frequencies of eighty meters through ten meters.

Another significant aspect and feature of the present invention is either parallel or series L-C circuits for loading and resonance of the structure for operating at predetermined frequencies of eight-, forty-, thirty-, seventeen- and twelve-meter band segments.

Having briefly described one embodiment of the present invention, it is a principal object hereof to provide a vertical antenna for operation on the high-frequency amateur radio frequencies of eighty meters through ten meters. The frequency segments are eighty/seventy-five meters, forty meters, thirty meters, twenty meters, seventeen meters, fifteen meters, twelve and ten meters. While the present invention has been disclosed for use on eight amateur radio frequency segments of the high-frequency spectrum, the specification is not to be construed as limiting of the present invention, as the principles of operation can be extended to any eight HF frequencies of operation as predetermined or nine frequencies when using an adapter.

One object of the present invention is a vertical antenna which operates on all of the amateur radio HF spectrum assignments as set forth by the Federal Communications Commission and requires no manual band switching when changing frequencies. The band switching is inherently electrical in the figurative sense, in that the entire height of the vertical antenna radiates on all frequencies except for fifteen meters where the upper portion of the antenna is automatically and electrically decoupled for quarter wavelength operation on fifteen meters in the first embodiment. The automatic and electrical band switching eliminates the need for manual band switching from the physical antenna itself or from a remote point. The teaching for the frequencies of this antenna are applicable to current and future FCC amateur radio frequency segments.

Another object of the present invention is to provide a vertical antenna with no traps and fewer tuned circuits than the prior art vertical antennas, thus simplifying the vertical antenna with resultant economies in time and construction materials. By utilizing resonator inductor-capacitor sections, no decoupling traps are required.

A further object of the present invention is to provide a vertical antenna having greater efficiencies because of longer active radiating sections of the upper high-frequency spectrum segments. Consequently, the band width is substantially increased for the high-frequency spectrum segments because of the lower Q of the longer radiating sections and top loading for each of the spectrum segments.

An additional object of the present invention is to provide a vertical antenna which provides readily accessible inplace adjustment on the thirty-, forty-, and eighty-meter bands where the Q is the highest.

Still an additional object of the present invention is to provide a vertical antenna which has small wind loading because the principal frequency control circuits are mounted on the lower half of the vertical antenna. The upper half of the antenna only needs to support its own weight thereby being much lighter and requiring very small diameter metal tubing.

BRIEF DESCRIPTION OF THE DRAWINGS

Other objects and many of the attendant advantages of this invention will be readily appreciated as the same becomes better understood, by reference to the following detailed description when considered in connection with the accompanying drawings, in which like reference numerals designate like parts throughout the figures thereof and wherein.

DESCRIPTION OF PREFERRED EMBODIMENTS

Figure 1:
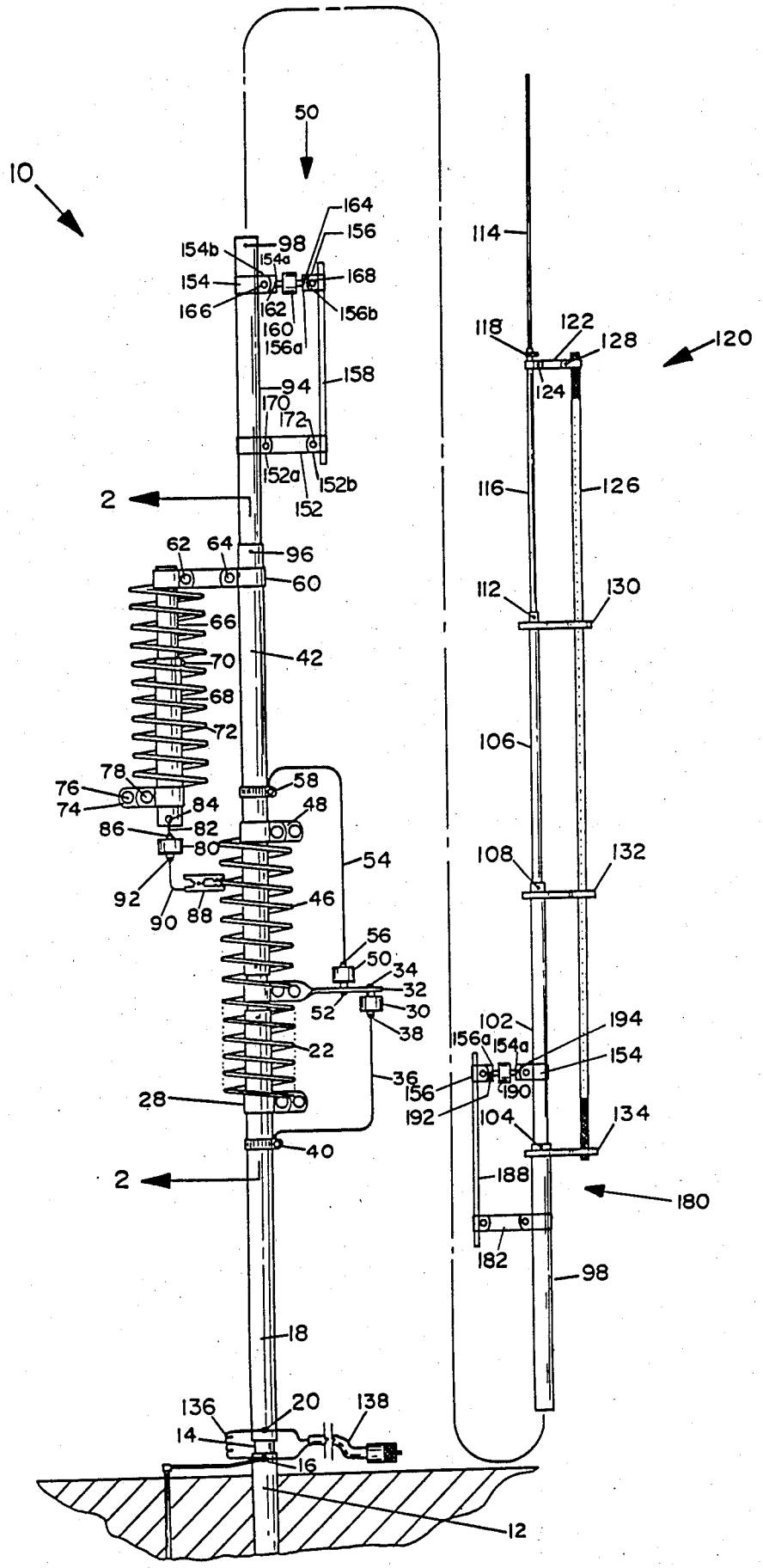
FIG. 1 illustrates a plan view of a vertical antenna, the present invention; and, FIG. 2 illustrates a sectional view taken along line 2—2 of FIG. 1.

FIG. 1, which illustrates a vertical plan view of a vertical antenna 10, the present invention, shows a hollow tubular metal mounting post 12 having a solid rod fiberglass insulator 14 of a diameter which telescopes internally into the mounting post 12, and secures thereto with a nut-and-bolt assembly 16. An eighty/seventy-five meter parallel inductor-capacitor metal section 18 has a lower hollow tubular portion of a diameter which telescopes over the solid insulator 14 and secures thereto with a nut-and-bolt assembly 20. An eighty-meter inductor coil 22 clamps between a top portion of the eighty-meter resonator capacitor section 18 to a mid-position immediately below an insulator assembly 24 as later described which telescopes into the section 42 and is secured thereto with a nut-and-bolt assembly 25. Coil clamps 26 and 28 surround the mid-portion of the insulator 24 above the section 18, position immediately below the insulator assembly 24 on the section 18 respectively, and secure thereto with nut-and-bolt assemblies in addition to securing the respective ends of the coil 22, as later described in FIG. 2. A ceramic capacitor 30 secures to one side of bracket 32 with a screw 34 and a bracket 36 secures to the other side of the capacitor 30 with a screw 38 and to the section 18 with a hose clamp 40. A forty-meter parallel inductor-capacitor metal section 42 has a hollow tubular lower portion of a diameter that telescopes over the insulator 24 and secures thereto with a nut-and-bolt assembly 44. A forty-meter resonator coil 46 clamps between a mid-portion of the forty-meter section 42 to a position immediately above insulator assembly 24, as later described. Coil clamp 48 surrounds the mid-portion of the forty-meter section 42 and secures thereto with nut and bolt assemblies in addition to securing the respective end of the coil 46. A ceramic capacitor 50 secures to one side of the bracket 32 with a screw 52. A bracket 54 secures to the other side with a screw 56 and to the section 42 with a hose clamp 58.

A clamp 60 including two nut-and-bolt assemblies 62 and 64 stand off short tubular insulator 66. A short metal tube 68 telescopes over the insulator 66 and secures thereto with a screw 70. A coil 72 connects between a second clamp 74 with nut-and-bolt assembly 76, the clamp 74 securing to the metal tube with nut-and-bolt assembly 78. A ceramic capacitor 80 secures with a bracket 82 and screws 84 and 86 between the tube 68 and the capacitor 80. An alligator clip 88 secures to a wire or braid 90 which screws with a screw 92 into the other end of the capacitor 80.

A lower end of a first metal section of hollow tubing 94 is of a diameter which telescopes into the top portion of the forty-meter resonator section 42 and secures thereto with a self-tapping screw 96. A lower end of a second metal section of hollow tubing 98 is of a diameter which telescopes into the top portion of the first metal section 94 and secures thereto with a self-tapping screw 100. A lower end of a third metal section of hollow tubing 102 is of a diameter which telescopes into the top portion of the second metal section 98 and secures thereto with a self-tapping screw 104. A lower end of a fourth metal section of hollow tubing 106 is of a diameter which telescopes into the top portion of the third metal section 102 and secures thereto with a self-tapping screw 108. A lower end of a fifth metal section 116 is of a diameter which telescopes into the fourth metal section 106 and secures thereto with a self-tapping screw 112. A lower end of a sixth metal section 114 is of a diameter which telescopes into a slotted top portion 118 of the fifth metal section 116 and secures thereto with a hose clamp 118. A fifteen-meter stub assembly 120 electrically and physically connects to the fifth section 110, as now described in detail.

The fifteen-meter stub assembly 120 includes a metal strap 122 electrically and physically secured to the fifth metal section 116 by a nut-and-bolt assembly 124. A metallic braid 126 wrapped around a nut-and-bolt assembly 128 extends downwardly parallel to the fifth through third sections 116–102. Plastic standoff insulators 130–134 physically space the stub assembly 126 from the upper portion of the vertical antenna 10. The bolt 128 electrically and physically secures the braid 126 to tube 110.

The 18-MHz-17 meter section 150 includes a lower clamp 152, an upper clamp 154 and a rod clamp 156. An inductor rod 158 acts as an inductor while capacitor 160 connects between the right-angle bends 154*a* and 156*a* with respective clamps. Bolts 162 and 164 secure the capacitor 160 to the right angle through respective holes. Each of the clamps 152–156 include overlapping portions 152*a*, 152*b*, 154*b* and 156*b* which encompass the circular sections of the tubing or rod, and are secured with appropriate nut-and-bolt assemblies 166, 168, 170 and 172. The rod 158 is 3/16" by way of example and for purposes of illustration, while the clamp width is approximately ½"×3.5" for the lower clamp and with like spacing between the rod and the tubing between the upper clamp, the capacitor bracket, and the rod. The distance between the lower clamp and the upper clamp-capacitor bracket is 124" from the bottom of the antenna to the lower bracket and 142.75" from the bottom of the antenna to the upper bracket. The rod length is approximately 24".

A 24 MHz-12 meter assembly 180 includes a like lower clamp 182, an upper clamp 154 and a capacitor clamp 156. A vertical inductor rod 188 connects between the clamps 182 and 156, and a capacitor 190 connects between right-angle portions 154*a* and 156*a* with bolts 192 and 194. Suitable nut-and-bolt assemblies are provided for the wrap-around portions of each respective clamp, accordingly, as previously described with respect to the lower 18 MHz-17 meter circuit. The rod length of 3/16" rod is approximately 36" with center-to-center spacing of 3½". The separation of the clamps from the base of the antenna is the difference between 157.75" and 183". Both capacitors are the bathtub ceramic variety of approximately 67 picofarads. The sections add little or no apparent loading at frequencies below the resonant frequencies of the decouplers and provide an equivalent series circuit of an L-C parallel combination.

An impedance matching coil 136 connects between the nut-and-bolt assembly 20 in the bottom of the eighty-meter section 18, and the nut-and-bolt assembly 16 in the top of the hollow tubular mounting post 12. A matching section length of seventy-five ohm coaxial cable transmission line 138 connects in parallel across the impedance matching coil and terminates in a suitable coaxial plug such as a PL-259. An electrical ground connects to the nut-and-bolt assembly 16, and the hollow tubular metal mounting post 12. The metal portions of the vertical antenna 10 can be aluminum tubing of predetermined diameter, by way of example and for purposes of illustration, while the insulators can be fiberglass, polyethylene, etc., by way of example and for purposes of illustration as later described.

Sections 150 and 180 for the 17-meter and 12-meter circuits can be positioned on the vertical section at any suitable assembly stage. The assembly of the clamps is similar to that of the clamps for the 30-, 40- and 80-meter circuits, especially with respect to the inductor rod and the capacitor. The clamps are assembled to the inductor rod, the capacitor is secured to the one clamp, and the other capacitor clamp is secured thereabout whereupon the whole assembly is secured to the vertical radiating section at the appropriate dimensions as previously set forth. The particular sections and resonance are obtained by adjusting the clamps and sections over the length of the vertical radiating section 42–114.

Figure 2:
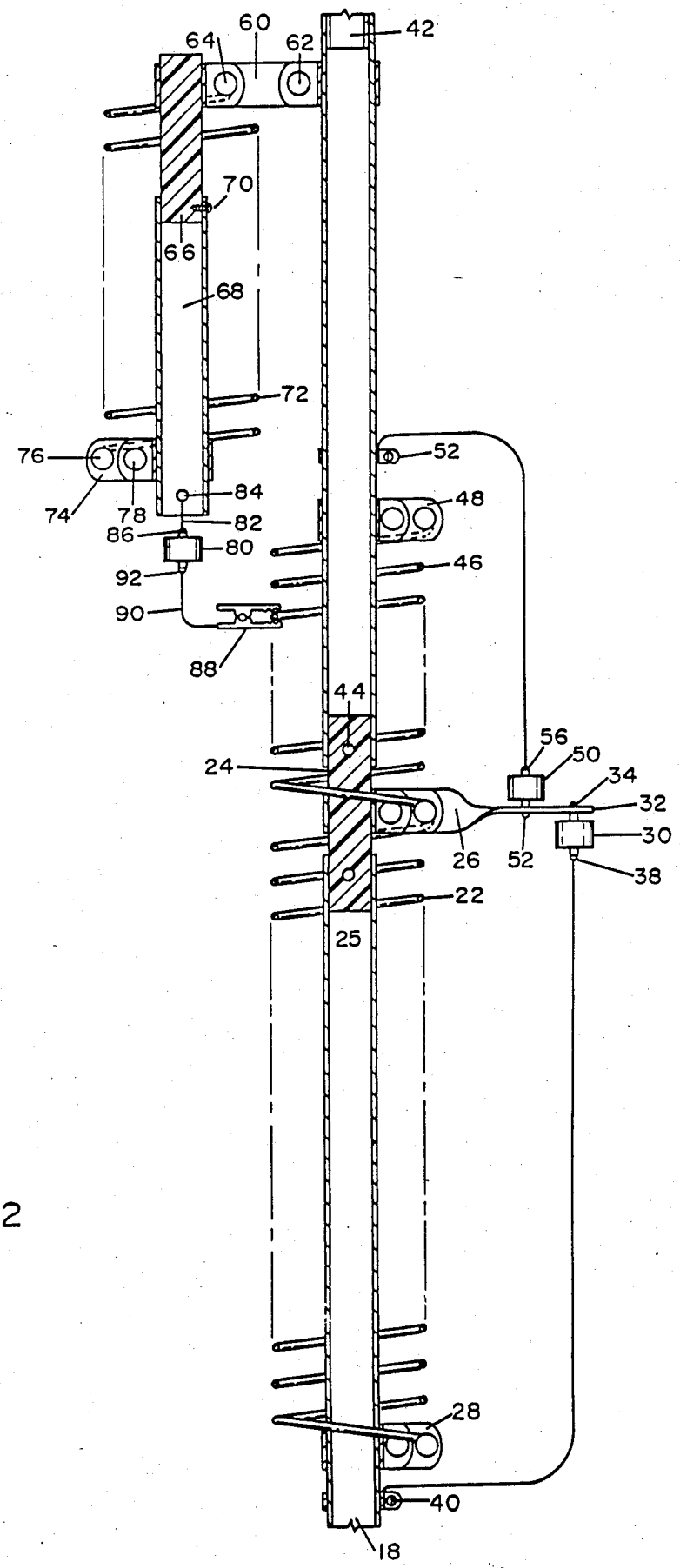

FIG. 2, which illustrates a sectional view taken along line 2—2 of FIG. 1, shows the eighty-meter section 18, the forty-meter section 42, and the thirty-meter inductor-capacitor section 68. Particular attention is drawn to the eighty-meter inductor 22 and the eighty-meter capacitor 30, the forty-meter inductor 46 and the forty-meter capacitor 50, and the thirty-meter inductor 72 and the thirty-meter capacitor 80. While the eighty- and forth-meter circuits are parallel LC circuits, the thirty-meter circuit is a series LC circuit. While the embodiment is for the 80, 40, and 30 meter high frequency spectrum segments, this is by way of example and for purposes of illustration only and is not to be construed as limiting of the present invention. All other numerals correspond to those elements previously described.

The coils of FIG. 2 are four-inch nominal diameter and are wound of aluminum tie wire. Coil 22 is seventeen turns, coil 46 is eight turns and coil 72 is nine turns. The capacitors 30, 50, and 80 are ceramic and are 200 pfd, 67 pfd, and 67 pfd respectively.

MODE OF OPERATION

The mounting post 12 of FIG. 1 is set into a suitable hole, approximately in the range of twenty-one inches deep, so that the upper end of the insulator 14 clears the ground a couple of inches. The earth is packed tightly around the mounting post, and concrete can be utilized for additional strength.

A No. 8 1¾" bolt 16 passes through the braid lug of the coaxial cable impedance matching transmission line 138, through a flat washer, through a lower loop of the impedance matching coil 136, through another opposing flat washer, through the hole in the mounting post 12 and the insulator 14, and secures with a flat washer, a lock washer, and a No. 8 nut. The eighty-meter resonator coil 22 has two clamps 26 and 28. A bolt assembly is removed from clamp 28 and the clamp 28 spread slightly apart. The top of eighty-meter resonator section 18 is first passed through the large clamp 28, the eighty-meter resonator coil 22, and then through the clamp 26. The screw hole in the clamp 26 of eighty-meter resonator coil 22 is aligned with the lower screw hole in the top of section 18, and secured with a nut-and-bolt assembly through the clamp 26 into the insulator 24. The ¼" by 1" bolt is replaced in the clamp 28, and the large clamp 28 is slid down the eighty-meter section 18 to a predetermined position. Subsequently the clamp 28 is tightened. The forty-meter resonator coil 46 is installed on the forty-meter section 42 in like manner and tightened at a predetermined position.

The lower end of first metal section 94 telescopes onto the top of forty-meter section 42. The screw holes are aligned in the sections 94 and 42 and secured with a No. 10–24 self-tapping screw 96. The bottom of second metal section 98 telescopes into the top of first metal section 94 and the screw holes are aligned and secured with a No. 10–24 self-tapping screw 100. An insulator 134 is positioned over the second metal section 98. The third metal section 102 telescopes into the second metal section 98, and the screw holes are aligned and secured with a No. 10–24 self-tapping screw 104. The fourth metal section 106 telescopes into the third metal section 102, and the screw holes are aligned and secured with a No. 6–32 self-tapping screw 108. The fifth metal section 116 telescopes into the fourth metal section 106 with the screw 112. The sixth metal section 114 telescopes into slotted end of section 116 and is secured with the small stainless steel hose clamp 118. The braid 126 connects to metal strap 122 with screw 128 and is supported at insulators 130–134. The insulators can be slitted for accepting the braid. Any excess braid can be wrapped around the lower insulator 134.

The bottom of the eighty-meter resonator capacitor section 18 is positioned over the top of the mounting post 12, and the screw holes aligned. A No. 8×1¾" bolt 20 passes through the center lug of the coaxial cable impedance matching transmission line 138, through a flat washer, through the upper loop of the impedance matching coil 136, through another opposing flat washer, through the sections 18 and 14 and is secured with a flat washer, a lock washer, and a No. 8 nut. The assembly of sections 42–114 is raised and positioned atop by telescoping the bottom of the forty-meter section 42 over the top of the insulator 24, aligning the screw holes, and securing with a No. 10–24 self-tapping screw 44.

The vertical antenna 10 produces very low-standing wave ratio (SWR) readings over the twenty-, fifteen-, and ten-meter bands, and the eighty/seventy-five-, forty- and thirty-meter resonator circuits are predetermined and set for resonances of approximately 3700, 7100, and 10,100 Khz. Inasmuch as some variation can be expected, the following procedure is utilized to adjust the vertical antenna 10 for minimum SWR at any desired point in each of the six bands of the HF spectrum. SWR readings can be taken at the transmitter end of the coaxial cable transmission feedline, or at the junction of the coaxial cable transmission feedline which is fifty-two ohm and the seventy-five ohm impedance matching transmission line 138 for greater accuracy.

The frequency of minimum SWR on fifteen meters is predetermined. To raise the frequency, the length of the braid 126 is decreased. The length of the assembly 120 is one-quarter wavelength or, nominally, twelve feet in length. The frequency of minimum SWR on twenty meters is predetermined. To raise or lower the frequency, the total length of sections 94 through 114 is adjusted by varying the amount of overlap between sections 116 and 114 a few inches. The frequency of minimum SWR on ten meters is predetermined. The twenty-meter adjustment also determines the ten-meter resonant frequency, but resonance on both bands is so broad that slight adjustments for the sake of improved SWR on one band do not significantly affect SWR on the other. The frequency of minimum SWR on forty meters is predetermined. Adjustment is made by loosening the upper clamp 48 of the forty-meter resonator coil 46, and compressing or expanding the spacing between coil turns to lower or raise the frequency respectively. One-half inch of travel will move the frequency of minimum SWR by approximately seventy Khz. When the proper setting has been determined, the clamp 48 is tightened in place. The frequency of minimum SWR on eighty or seventy-five meters is predetermined. Adjustment is made in a like manner by repositioning the lower clamp 28 on the eighty/seventy-five meter resonator coil 22. Likewise, adjustment to the thirty-meter coil 72 is made in a like manner with clamp 74. The clip 88 connects to the second or third turn of coil 46. The tap clip 88 is connected as high as possible on coil 46 so as not to affect the twenty-meter resonance. When the proper setting has been determined and the lower clamp 28 is tightened, the impedance matching coil 136 is adjusted at the base of the vertical antenna 10 by spreading the turns farther apart or squeezing them closer together until the SWR drops to a minimum value. One adjustment of the impedance matching coil should suffice for operation over the entire 3500–4000 Khz range, provided that the necessary adjustments are made to the eighty/seventy-five meter resonator coil 22. In general, the thirty-, forty- and eighty/seventy-five-meter adjustments with not significantly affect adjustments previously made for twenty, fifteen, and ten meters. However, if the eighty/seventy-five meter tuning is readjusted for operation at a much higher or lower frequency, it may be necessary to readjust the thirty- or forty-meter turning in order to maintain SWR or less than 2:1 at both band edges.

The vertical antenna 10 is constructed of commercially available components including aluminum tubing of 3/8, ½, ⅝, ¾, ⅞, 1 and 1⅛ inch outer diameters of predetermined lengths, aluminum tie wire, fiberglass insulators and the like components. The aluminum tubing can be 0.058 wall 6061—T6 leading to an antenna weight of less than ten pounds. The height of the antenna is approximately twenty-six feet. The eighty-meter resonator capacitor section 18 is four feet; the forty-meter resonator capacitor section 42 is one foot; and sections 94–114 are each approximately four feet. The fifteen-meter stub assembly 120 is tined braid, but could be 3/16" rod or hollow tubing, or, in the alternative, can be made entirely hollow tubing, or, in the alternative, can be made entirely of 3/16" rod joined together by a clamp.

The vertical antenna is easily capable of handling transmitter input power of 2000 wats SSB or 1000 watts CW. Fifty-ohm coaxial cable transmission line connects to the impedance matching section 138. The VSWR at resonance is less than 1.5:1.

With regards to the inductor coil-capacitor structure, the 40 meter section is self resonant near 30 meters. The series circuit resonance near 30 meters effectively shorts out part of the 40 meter parallel circuit thus changing its resonance during operation in the 30 meter range and thus allowing the whole structure to resonate as a quarter wavelength monopole in the same frequency range.

It is important to note that the capacitor-inductor structure of either the 80, 40, or 30 meter circuits can be adapted to other antennas such as beams or other vertical antennas. The theory of operation is an L-C reactance generating network to produce an additional resonance on an existing antenna. The capacitance shunt across a portion of the radiator forms a parallel resonant high impedance decoupling circuit. The inductance can be varied by either the distance of the capacitor straps or through an inductor. The resultant circuit formed is antiresonant at a higher frequency. The circuit loads the radiator so that the radiator becomes resonant at some lower frequency below in which case the portion of the radiator above the capacitor can be shortened to restore the orginal resonance. In the alternative, the capacitance can be adjusted to resonate at a frequency below that of the desired second resonance, in which case the entire structure can be made to resonate at the desired higher frequency.

Various modifications can be made to the vertical antenna of the present invention without departing from the apparent scope thereof. The resonance on segments of the high-frequency spectrum is predetermined for the desired frequency of operation and is not limited to the eighty/seventy-five, forty, thirty, twenty, seventeen, fifteen, twelve and ten meter band segments of the present invention which has been by way of example and for purposes of illustration only, and is not to be construed as limiting of the present invention.

Having thus described the invention, what is claimed is:

1. Vertical antenna resonating on eight predetermined segments of the high-frequency spectrum comprising:

a. first inductor-capacitor means vertically supported and comprising an eighty/seventy-five meter section including an eighty/seventy-five meter inductor and capacitor connected in parallel across the top of said section, said inductor adjusting the center frequency of operation;

b. second inductor-capacitor means vertically connected to said first inductor-capacitor means and comprising a forty-meter section including a forty-meter inductor and capacitor connected in parallel across the top of said section, said inductor adjusting the center frequency of operation, and said inductors and capacitors connecting at a common point on an insulator between said sections;

c. vertical radiating means connected to said second inductor-capacitor means by an insulator post, said vertical radiating means comprising first, second, third, fourth, fifth, and sixth vertical radiating sectional elements secured to each of the other respective elements;

d. third inductor-capacitor means vertically supported and comprising a thirty-meter inductor and capacitor connected in series between said forty-meter inductor and said vertical radiating element;

e. stub means connected to a top portion of said vertical radiating means, spaced a fraction of a wavelength therefrom and extending parallel downwardly therefrom, said stub means substantially one-quarter wavelength of fifteen meters;

f. first decoupling means connected to a mid-portion of said vertical radiating means and including a parallel inductor-capacitor section for decoupling at seventeen meters;

g. second decoupling means connected to said vertical radiating means and above said first decoupling means spaced therefrom, and including a parallel inductor-capacitor circuit for decoupling at twelve meters; and h. an impedance matching coil connected across said first inductor-capacitor means and ground, a coaxial cable transmission line impedance matching section connected across said impedance matching coil, and said vertical antenna having a height in the range of twenty-five to twenty-six feet whereby a coaxial cable transmission line connected to said first inductor-capacitor means and ground, and the entire vertical radiating length of said vertical antenna is active on five of said eight high-frequency spectrum segments and said stub means decouples said vertical radiating means above said stub means thereby yielding a quarter wave vertical radiating means on the frequency corresponding to the length of said stub means.

2. Vertical antenna of claim 1 wherein said vertical radiating means comprises a longitudinal metal tube.

3. Vertical antenna for operation on the eighty/seventy-five, forty-, thirty-, twenty-, seventeen-,fifteen-, twelve- and ten-meter high-frequency segmeents of the high-frequency spectrum comprising:

a. tubular support post including a solid fiberglass insulator extending therefrom and secured to said support post with a nut-and-bolt assembly;

b. eighty-meter inductor-capacitor section including an eighty-meter inductor supported at the top of said eighty-meter section and a capacitor connected in parallel across said inductor and vertically supported on said insulator;

c. forty-meter inductor-capacitor section including a forty-meter inductor supported at the top of said forty-meter section and a capacitor connected in parallel across said forty-meter inductor section and vertically affixed to said eighty-meter resonator capacitor section;

d. first, second, third, fourth, fifth and sixth vertical section radiating elements, said first element vertically affixed to the top of an insulator telescoped into said forty-meter section with a self-tapping sheetmetal screw, said second element telescoped into said first element and secured thereto with a self-tapping sheetmetal screw, said third element telescoped into said second element and secured thereto with a self-tapping sheetmetal screw, said fourth element telescoped into said third element and secured thereto with a self-tapping sheetmetal screw, said fifth element telescoped into a top portion of said fourth element and secured thereto with a self-tapping sheetmetal screw, and said sixth element telescoped into a slotted top portion of said fifth element and secured thereto with a hose clamp;

e. thirty-meter capacitor section vertically supported and including a thirty-meter inductor-capacitor connected in series between a tap on said forty-meter inductor and a lower portion of said vertical radiating elements;

f. seventeen-meter section including a rod inductor, two clamps connected to said rod inductor at eight end with overlapping portions and nut-and-bolt assemblies securing thereto, an upper clamp including a right-angle bend, a capacitor connected between said right-angle bend and a second upper clamp including a right-angle bend, and an overlapping section, said overlapping sections of said upper clamp and lower clamp secured to a mid-portion of said vertical radiating element;

g. fifteen-meter quarter wave stub section including insulators positioned over and extending outwardly from said second and third elements, a braid and a bracket including nut-and-bolt assemblies affixing a top of said braid to said fifth element, said braid one-quarter wavelength of fifteen meters in length; and, h. twelve-meter inductor-capacitor section including an inductor rod, an upper and lower clamp with overlapping portions secured thereto by nut-and-bolt assemblies, said upper clamp including a right-angle bend, a capacitor secured between said right-angle bend and right-angle bend of a second upper clamp, said second upper clamp having an overlapping end for securing to said vertical radiating element along with an over-lapping end of said lower clamp with nut-and-bolt assemblies, said twelve-meter section secured to said vertical radiating element above said seventeen-meter section whereby said eight-meter inductor adjusts the center frequency of operation on eighty meters, said forty-meter inductor adjusts the center frequency of operation on forty meters, said thirty-meter inductor adjusts said center frequency of thirty meters, the center frequency of operation on twenty meters is adjusted by telescoping said radiating elements into each other, the center frequency of operation on fifteen meters adjusted by the length of said braid, the center frequency of operation of ten meters is adjusted by telescoping said radiating elements into each other for low voltage standing wave ratio on each of the center frequencies, and the center frequency of operation on seventeen and twelve meters is adjusted by positioning the sections on the mid-portions of said vertical radiating element.

4. Antenna of claim 3 wherein said eight-meter inductor is seventeen turns and said capacitor is 200 pfd.

5. Antenna of claim 3 wherein said forty-meter inductor is eleven turns and said capacitor is 67 pfd.

6. Antenna of claim 3 wherein said thirty-meter inductor is nine turns and said capacitor is 67 pfd.

* * * * *